United States Patent [19]

Schwab et al.

[11] Patent Number: 4,885,824

[45] Date of Patent: Dec. 12, 1989

[54] ADJUSTABLE TENSION FASTENER

[75] Inventors: Leonard M. Schwab, 3 Olde Lantern Rd., Acton, Mass. 01720; Steven Caney, Centre Harbor, N.H.

[73] Assignee: Leonard M. Schwab, Acton, Mass.

[21] Appl. No.: 239,641

[22] Filed: Sep. 2, 1988

[51] Int. Cl.[4] ..... F16L 33/00

[52] U.S. Cl. ..... 24/17 B; 24/115 H

[58] Field of Search ..... 24/17 B, 17 AP, 16 R, 24/300, 301, 482, 30.56, 114.5, 115 H, 115 G

[56] References Cited

U.S. PATENT DOCUMENTS

| | | | |
|---|---|---|---|
| 102,536 | 5/1870 | Gundaker | 24/17 B |
| 516,568 | 3/1894 | Garland | 24/114.5 |
| 983,686 | 2/1911 | Cobb | 24/16 R |
| 1,065,190 | 6/1913 | Tobin | 24/114.5 |
| 1,153,334 | 9/1915 | Oswald | 24/300 |
| 1,373,349 | 3/1921 | Peardon | 24/114.5 |
| 2,572,889 | 10/1951 | Strykower | 24/115 H |
| 3,988,850 | 11/1976 | Steinman | 24/115 H |
| 4,221,024 | 9/1980 | Becker | 24/115 H |
| 4,364,538 | 12/1982 | Tomlinson | 24/115 H |
| 4,569,108 | 2/1986 | Schwab | 24/17 AP |

*Primary Examiner*—Victor N. Sakran

*Attorney, Agent, or Firm*—Joseph s. Iandiorio; Brian M. Dingman

[57] ABSTRACT

An adjustable tension fastener which consists of a rigid loop-hook having a rigid loop member and a rigid hook member and a flexible cord connected to the rigid loop member by a pull-through knot for defining a tension portion and a reserve portion of the cord. A binder is used for selectively adjusting the length and tension of the tension portion and securing the rigid loop-hook to a portion of the flexible cord.

10 Claims, 2 Drawing Sheets

30
32
12
22
28
26
24
20
21
16
18
19
14
10

34
21
20
34
12

12
18
14
36
19
36
21
20
28

22
10
28
24
20
21
16
38
40
18
19
14

ADJUSTABLE TENSION FASTENER

FIELD OF INVENTION

This invention relates to an adjustable tension fastener and more particularly to such a fastener having a rigid loop-hook that is placed adjustably on a flexible cord.

BACKGROUND OF INVENTION

Tension fasteners are used, for example, for securing covers and various other items to boats, cars, motorcycles, and the like, for bundling packages, and for tying loose items together. The most common prior art devices include linear elastic cords having hooks bound at each end. Such devices work well when the elastic cords are sufficiently stretched to create enough tension to hold the fastener in place. Problems occur, however, when the tension fastener is too long or too short for the job at hand. For fasteners that are too long, intuitive ways of connecting the end hooks must be thought of to eliminate the slack. A commonly used method is to wrap the excess length of a flexible tension fastener around some portion of the fastened object. A commonly used method when the fastener is too short is to interconnect two or more fasteners together. When this method is used the fasteners often fall apart from one another unless tension is constantly applied.

Another type of tension fastener that is currently available is disclosed in U.S. Pat. No. 4,569,108 issued to Leonard M. Schwab. That device includes a rigid closed metal loop-hook and a closed loop elasticized band attached to the loop portion of the hook by a pull-through knot. Such a device lends itself to easily replacing the closed loop elasticized band with one of suitable length or attaching additional loop-hooks; however, it is not otherwise adjustable in length or tension (except by the previously mentioned method of wrapping of the excess length about the fastened object).

SUMMARY OF INVENTION

It is therefore an object of this invention to provide an improved tension fastener which is adjustable in size.

It is a further object of this invention to provide such a tension fastener which achieves tension by using elastic bands or loops.

It is a further object of this invention to provide such a tension fastener which permits a user to easily add additional hooks.

It is a further object of this invention to provide such a tension fastener which can be adjusted either during or before use.

It is a further object of this invention to provide such a tension fastener which permits a user to easily tie back excess strap of the fastener onto itself after adjusting the length or tension of the fastener.

This invention results from the realization that a truly effective adjustable tension fastener can be accomplished by attaching a closed-loop flexible cord to a rigid loop-hook using a pull-through knot, which defines a tension portion and a reserve portion of the cord, and securing a binder to the flexible cord proximate to the knot to limit the length of the tension portion of the cord by preventing the reserve portion of the cord from slipping through the knot.

The present invention features an adjustable tension fastener. The fastener includes a rigid loop-hook having a rigid loop member and rigid hook member. A flexible cord is connected to the rigid loop member by a pull-through knot and defines a tension portion and a reserve portion of the flexible cord. Means are included for selectively adjusting and securing the rigid loop-hook to a portion of the flexible cord for adjusting the length and tension of the tension portion.

The flexible cord may be made from elastic material having two ends securely joined together by a metal clamp to form a closed loop. The ends can be clamped together so that the ends are parallel and immediately adjacent to one another. A relatively soft tip is disposed over the clamp. The means for selectively adjusting and securing can include a buckle means such as a slack retainer pad having a hole sized to friction fit two sections of the flexible cord together. The retainer pad is placed proximate to the rigid loop portion of the rigid loop-hook.

In an alternate embodiment the means for adjusting can include a buckle means such as a block having a first and second channel for receiving one end of the flexible member through each channel in one direction and for receiving the other end of the flexible member through each channel in the opposite direction. The channels are sized to frictionally fit the flexible member within each channel when the flexible member is unstretched.

In another embodiment an adjustable fastener includes an elastic member and buckle means adapted to the elastic member for defining a tension portion and a reserve portion. The size of the tension portion is adjusted by selectively pinching off two sides of the elastic member. A rigid loop-hook is attached to the tension portion of the elastic member by a pull-through knot. The buckle means includes a block having two channels for receiving one end of said elastic member through each channel in one direction and for receiving the other end of said elastic member through each channel in the opposite direction.

DISCLOSURE OF PREFERRED EMBODIMENT

Other objects, features and advantages will occur to those skilled in the art from the following description of a preferred embodiment and the accompanying drawings, in which.

This invention may be accomplished by connecting a flexible cord to a rigid loop member of a rigid loop-hook using a pull-through knot, which defines a tension portion and a reserve portion of the cord. Preferably the rigid loop-hook is a blind hook which does not expose sharp tips or ends. The loop-hook may be formed by suitably bending wire or by stamping it from sheet stock using a punch press. The rigid loop-hook is selectively adjusted and secured to a portion of the flexible cord by a binder for adjusting the length and tension of the tension portion. The binder is placed proximate to the rigid loop portion of the rigid loop-hook and prevents the reserve portion from slipping through the knot. The binder may be a slack retainer pad having a hole sized to friction-fit two sections of the flexible cord together.

In the preferred embodiment the pad is made of rigid thermoformed or thermoset plastic material. The flexible cord may consist of a single length of braided elastic material having two ends which are securely joined together to form a closed loop. In the preferred construction the ends are secured together by a clamp so that they are parallel and immediately adjacent to one another. The clamp limits the pad from slipping off the reserve portion, thereby keeping the knot from becoming untied, and provides a more secure method for binding the ends of the flexible cord for preventing unraveling of the braided elastic cord material.

In another construction, the adjustable tension fastener includes a buckle adapted to receive the ends of an elastic member for defining a tension portion and a reserve portion. The buckle consists of a block having two channels for receiving one end of the elastic member through each channel in one direction and for receiving the other end of the elastic member through each channel in the opposite direction. The channels are sized to frictionally fit and, hence, bind the elastic members in an unstretched state. The buckle allows the length and tension of the tension portion to be adjusted by selectively pinching off two sides of the elastic member. A rigid loop-hook is attached to the tension portion of the elastic member by a pull-through knot.

Figures 1, 2, 3, 4:
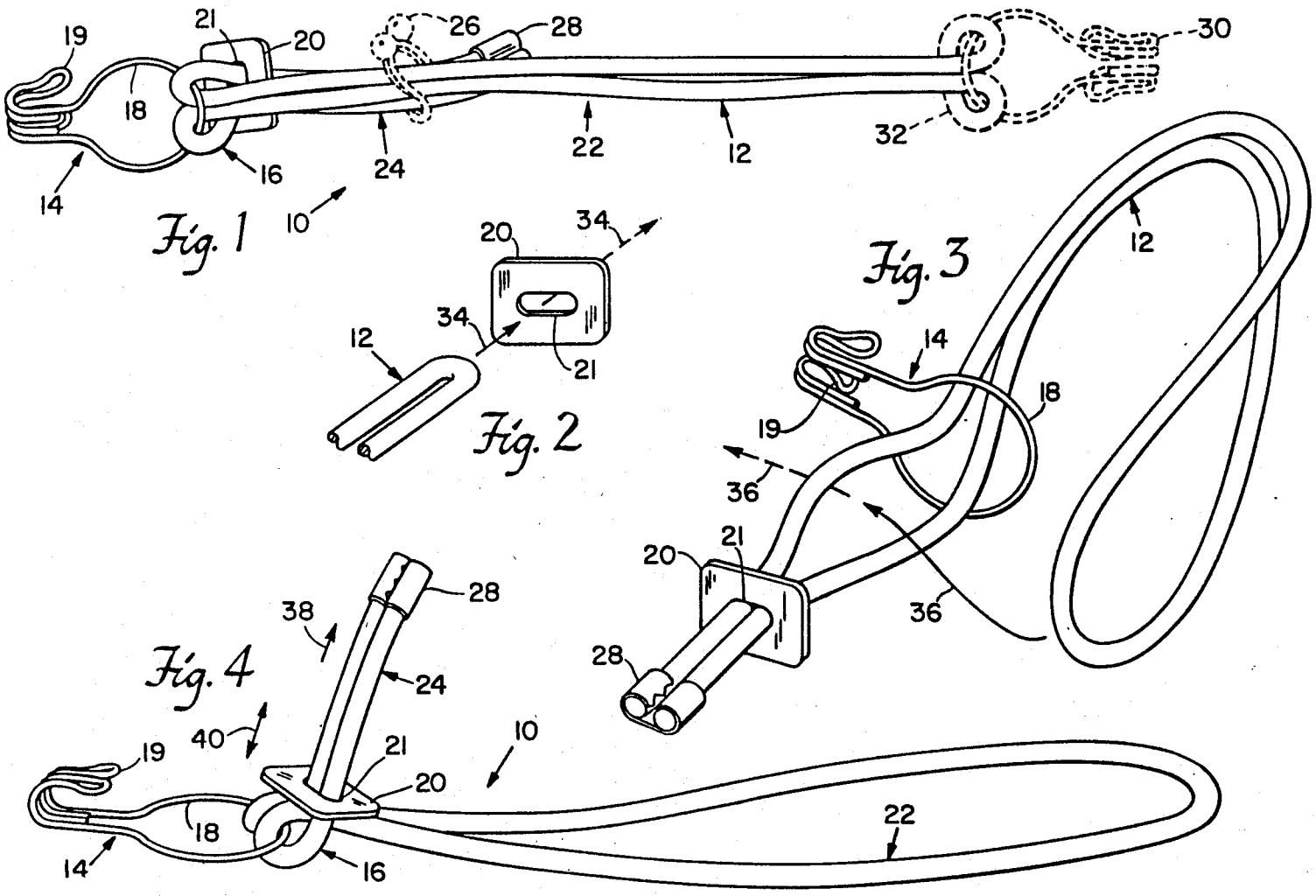
FIG. 1 is a three-dimensional view of an adjustable tension fastener according to the present invention.
FIGS. 2–4 illustrate a series of steps for tying the pull-through of FIG. 1.

The adjustable tension fastener 10 according to this invention, FIG. 1, includes a flexible cord 12 connected to a rigid loop-hook 14 by a pull-through knot 16. Knot 16 is tied to a rigid loop member 18 of rigid loop-hook 14. A binder 20 is placed proximate rigid loop portion 14 and defines a tension portion 22 and a reserve portion 24. Binder 20 is used for adjusting the length and tension of tension portion 22 by preventing reserve portion 24 from slipping through knot 16. A removable clasp 26 is used for securing reserve portion 24 to tension portion 22 to restrict the freedom of movement of reserve portion 24.

Figures 1A, 5:
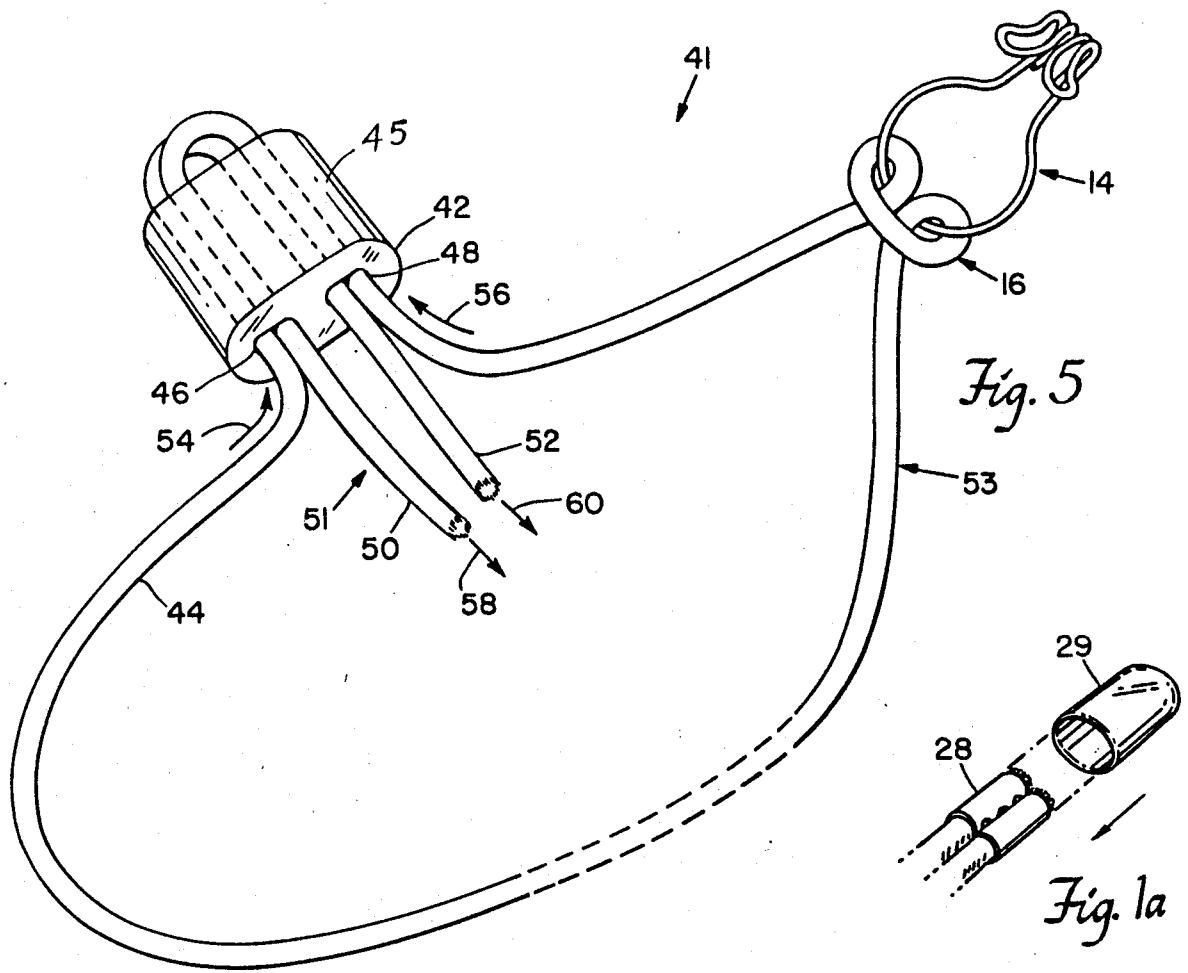
FIG. 1A is a three-dimensional view of a relatively soft tip placed over the metal clamp shown in FIG. 1.
FIG. 5 a three-dimensional view of an alternate embodiment of the present invention.

In the preferred construction, flexible cord 12 consists of a length of elastic material having its ends bound by a clamp 28 to form a closed loop. The ends of flexible cord 12 are bound by clamp 28 so that they are parallel and immediately adjacent to one another. Clamp 28 is made of rigid durable material such as metal which is sized to prevent it from passing through a hole 21 in binder 20. Preferably, a plastic or rubber tip 29 is placed over clamp 28, as illustrated in FIG. 1A, to protect the object that is bound by fastener 10 from scratches or nicks that might otherwise occur. Other methods may also be employed for clamping together the ends of flexible cord 12 or for securing a relatively soft tip to the clamp. By creating a loop with flexible cord 12, an additional rigid loop-hook 30 can easily be secured to adjustable tension fastener 10 at arbitrary locations along the tension portion 22 by a pull-through knot 32. Additional rigid loop-hooks may similarly be attached to tension portion 22.

Adjustable tension fastener 10 is assembled by inserting a folded portion of flexible cord 12 through hole 21 of binder 20 as indicated by arrows 34, FIG. 2. Hole 21 is sized to friction-fit flexible cord 12 in an unstretched state. Binder 20 is slid over flexible cord 12 toward clamp 28 as shown in FIG. 3. Flexible cord 12 is then threaded through rigid loop member 18 of rigid loop-hook 14 and doubled back and threaded between portions of flexible cord 12 as indicated by arrows 36. Flexible cord 12 is then pulled taut against the rigid loop-hook until pull-through knot 16 is formed and binder 20 is proximate rigid loop portion 18 of rigid loop-hook 14, FIG. 4.

Adjustable tension fastener 10 may now be used to bundle, tie down, or fasten objects together by connecting tension portion 22 at one location and by fastening a hook member 19 of rigid loop-hook 14 to another location. Alternately, hook member 19 may be wrapped around an object and connected to tension portion 22. The length and tension of tension portion 22 may be adjusted while connected by pulling reserve portion 24 in the direction indicated by arrow 38 and pushing binder 20 toward or away from loop knot 16 as indicated by arrow 40.

In another embodiment, shown in FIG. 5, an adjustable tension fastener consists of a buckle 42 and an elastic member 44. Buckle 42 consists of a block 45 having two channels 46, 48 for receiving one end of elastic member 50 through each channel 46, 48 in one direction and for receiving the other end of elastic member 52 through each channel 46, 48 in the opposite direction. The ends 50, 52 extending from block 45 define a reserve portion 51 and the remainder of elastic member 44 defines a tension portion 53. Channels 46, 48 are sized to friction-fit the ends of elastic member 44 in an unstretched state. A rigid loop-hook 14 is attached to elastic member 44 by a pull-through knot 16.

Tension portion 53 may have its length reduced and tension increased by feeding a portion of elastic member 44 through channels 46 and 48 as indicated by arrows 54, 56 and pulling ends 50, 52 as indicated by arrows 58 and 60. Tension portion 53 may have its length increased and tension reduced by performing an adjustment defined by reversing the direction of arrows 54, 56, 58 and 60.

Although specific features of the invention are shown in some drawings and not others, this is for convenience only as each feature may be combined with any or all of the other features in accordance with the invention.

Other embodiments will occur to those skilled in the art and are with the following claims. For example a clasp or closure device may be used to replace the binder.

What is claimed is:

1. A slip-proof adjustable tension fastener comprising:

a rigid loop-hook having a rigid loop member and a rigid hook member;

a flexible elastic cord connected to said rigid loop member by a pull-through know for defining a stretchable tension portion and a slack reserve portion of said cord; and a retainer member having a hole for receiving said reserve portion, said hole sized to allow said elastic cord to slip through in a stretched state and friction fit said cord to tightly hold said cord in a relaxed state;

said retainer member on said reserve portion proximate said pull-through knot for allowing adjustment of the length of said tension portion and preventing said knot from slipping when said tension portion is stretched.

2. The adjustable tension fastener of claim 1 in which said pad is made of thermoformed plastic material.

3. The adjustable tension fastener of claim 1 in which said pad is made of a thermoset plastic material.

4. The adjustable tension fastener of claim 1 further including means for forming said flexible cord into a closed loop having two ends which are securely joined together.

5. The adjustable tension fastener of claim 4 in which the ends of said flexible cord are clamped together so that the ends are parallel and immediately adjacent to one another.

6. The adjustable tension fastener of claim 4 in which said means for forming includes a metal clamp.

7. The adjustable tension fastener of claim 6 further including a relatively soft tip disposed over the metal clamp.

8. The adjustable tension fastener of claim 1 further including means for tying said reserve portion to said tension portion.

9. The adjustable tension fastener of claim 1 in which said rigid loop-hook is a blind hook.

10. The adjustable tension fastener of claim 1 further including at least two rigid loop-hooks connected to said tension portion by pull-through knots.

* * * * *